US008119894B2

(12) United States Patent
Cheng et al.

(10) Patent No.: US 8,119,894 B2
(45) Date of Patent: Feb. 21, 2012

(54) SHOULDER REST FOR A STRINGED INSTRUMENT

(75) Inventors: Ning-Man Cheng, Hong Kong (CN); Alexander Hsiao Wang Ling, Hong Kong (CN)

(73) Assignee: Ergo Acoustics Lab Limited, Hong Kong (HK)

( * ) Notice: Subject to any disclaimer, the term of this patent is extended or adjusted under 35 U.S.C. 154(b) by 45 days.

(21) Appl. No.: 12/919,765

(22) PCT Filed: Feb. 26, 2009

(86) PCT No.: PCT/CN2009/070548

§ 371 (c)(1),
(2), (4) Date: Aug. 27, 2010

(87) PCT Pub. No.: WO2009/106005

PCT Pub. Date: Sep. 3, 2009

(65) Prior Publication Data

US 2011/0000358 A1 Jan. 6, 2011

Related U.S. Application Data

(60) Provisional application No. 61/032,431, filed on Feb. 29, 2008.

(51) Int. Cl.
*G10D 3/00* (2006.01)
*G10G 5/00* (2006.01)

(52) U.S. Cl. ..... 84/327

(58) Field of Classification Search ..... 84/327, 84/328

See application file for complete search history.

(56) References Cited

U.S. PATENT DOCUMENTS

| | | | | |
|---|---|---|---|---|
| 2005/0120860 | A1* | 6/2005 | Chen | 84/328 |
| 2006/0207405 | A1* | 9/2006 | Armstrong et al. | 84/327 |
| 2010/0319515 | A1* | 12/2010 | Cadd | 84/327 |

FOREIGN PATENT DOCUMENTS

| | | | |
|---|---|---|---|
| CN | 2137387 | Y | 6/1993 |
| WO | 01/71705 | A | 9/2001 |
| WO | 2006/117564 | A | 11/2006 |

* cited by examiner

*Primary Examiner* — Jeffrey Donels
(74) *Attorney, Agent, or Firm* — Eagle IP Limited; Jacqueline C. Lui

(57) ABSTRACT

A shoulder rest (50) comprises an attachment piece (60), an abutment piece (62), and a padding piece (64) and is adapted for supporting a stringed instrument (80) such as violin or viola during playing, wherein the attachment piece (60) is adapted to clip onto an end button (82) of the stringed instrument (80) such that the contact surface between the stringed instrument (80) and the shoulder rest (50) is juxtaposing a bottom block of the stringed instrument (80).

13 Claims, 6 Drawing Sheets

SHOULDER REST FOR A STRINGED INSTRUMENT

RELATED APPLICATIONS

This patent application is a National Stage of International Application Serial No. PCT/CN2009/070548, filed on 26 Feb. 2009, which claims the benefit of a U.S. of America Patent Application Ser. No. 61/032,431, filed on 29 Feb. 2008, the disclosures of which are all incorporated herein by reference in their entireties.

FIELD OF INVENTION

This invention relates to a shoulder rest for stringed instrument such as violin or viola intended for support on a shoulder of a user.

BACKGROUND OF INVENTION

Many violinists or violists have often experienced pain or fatigue over their neck and/or shoulder area from playing their instruments. The contact of the hard wooden back of a violin/viola further aggravates the clavicle bone, especially after prolonged practice or play. Therefore, the introduction of a shoulder rest for supporting the violin/viola seems to be an effective solution to improve the player's comfort and providing good security of the instrument on the shoulder.

However, a number of virtuoso violinists/violists discourage the use of shoulder rest. One of the demerits they argue is that conventional shoulder rests may freeze the shoulder joint movement due to its inherent design, essentially restricting the freedom of movement of the violin on the shoulder, resulting in the loss of the necessary dynamic interactions between the violin, the bow and the player.

A conventional bridge-type shoulder rest may also hinder the smooth transmission of sound from the violin to the body of the user. In other shoulder rest designs, metal clamps are incorporated thereon for securing the violin which may also damage the violin body.

SUMMARY OF INVENTION

In the light of the foregoing background, it is an object of the present invention to provide an alternate shoulder rest for supporting a stringed instrument, especially for violin and viola.

Accordingly, the present invention, in one aspect, is a shoulder rest for supporting a stringed instrument which comprises an attachment piece, an abutment piece, and a padding piece. The attachment piece is adapted to secure the shoulder rest to a tail-pin of the stringed instrument and the abutment piece, extending from the attachment piece, is adapted to provide support to the stringed instrument once rested onto the shoulder rest. In one embodiment, the attachment and abutment pieces are coupled to form an L-shaped support configuration for providing an area for contact between the stringed instrument and the shoulder rest to support the stringed instrument. The padding piece connects to the abutment piece and is adapted to rest on and conform to the contour of a shoulder of a user. It is further adapted to simultaneously contact the shoulder and the clavicle of the user during usage. Further, the attachment piece is adapted to clip onto an end button of the stringed instrument such that the contact surface between said stringed instrument and said shoulder rest is juxtaposing a bottom block of said stringed instrument.

In yet another embodiment, the abutment piece comprises a rigid material to minimize any contact between a bottom board of the stringed instrument and the shoulder rest upon attachment of said attachment piece onto said stringed instrument. As such, damping of said stringed instrument resting on said shoulder rest could be prevented during usage.

According to another aspect of the present invention, a shoulder rest for supporting a stringed instrument is provided and comprises an attachment plate, an abutment piece, and a flexible pad. The attachment plate contains a first end and an opposing second end. The first end further has a slot provided therein and adapted to mate with an end button of the stringed instrument for securing the shoulder rest to the stringed instrument. The abutment piece rigidly extends from the second end of the attachment plate such that a substantially L-shaped support is formed therebetween to provide an area for contact between the stringed instrument and the shoulder rest to support the stringed instrument. Further, the stringed instrument enables the contact surface to be at a bottom block of the stringed instrument such that the angle formed between the attachment plate and the abutment piece allows the abutment piece to support the edge of a bottom board juxtaposing said bottom block during usage while minimizing the contact of the bottom board of the stringed instrument with the shoulder rest. The pad, attaching to and spreading around the abutment piece along the plane thereof, is adapted to simultaneously contact and protect the shoulder and the clavicle of the user during usage.

Being rigid but flexible, the L-shaped support formed by the coupling of the attachment and abutment pieces is allowed to be forced open upon attachment of the shoulder rest to the stringed instrument. The abutment piece would then be forced away from the stringed instrument such that contacts between the shoulder rest and the stringed instrument, and thus the damping of the stringed instrument resting thereonto, could be minimized.

Also, due to its inherent design, the ridge-shaped abutment piece of the shoulder rest of this invention helps in preventing the dropping of the scroll of the violin or viola during playing and so the hand holding the stringed instrument can have complete freedom of movements to attain a full range of orientations and directions. Further, the playing ergonomics of the arm holding the stringed instrument can be improved.

DETAILED DESCRIPTION OF THE PREFERRED EMBODIMENTS

As used herein and in the claims, "comprising" means including the following elements but not excluding others. When interpreting each statement in this specification that includes the term "comprising", features other than that or those prefaced by the term may also be present. Related terms such as "comprise" and "comprises" are to be interpreted in the same manner.

The term "formable" refers to the nature of a material that allows for a substance made thereof to have its shape readily changeable, but once changed, it can retain the shape.

"Proximal side" refers to the side of the shoulder of a user that is closer to the neck. Likewise, its counterpart, "distal side", refers to the side of the shoulder near the arm and positioned farther away from the neck. Correspondingly, "proximal clavicle" means the side of the clavicle of a user closer to the neck of that user, whereas "distal clavicle" is the opposing side of the "proximal clavicle".

Figure 1A:
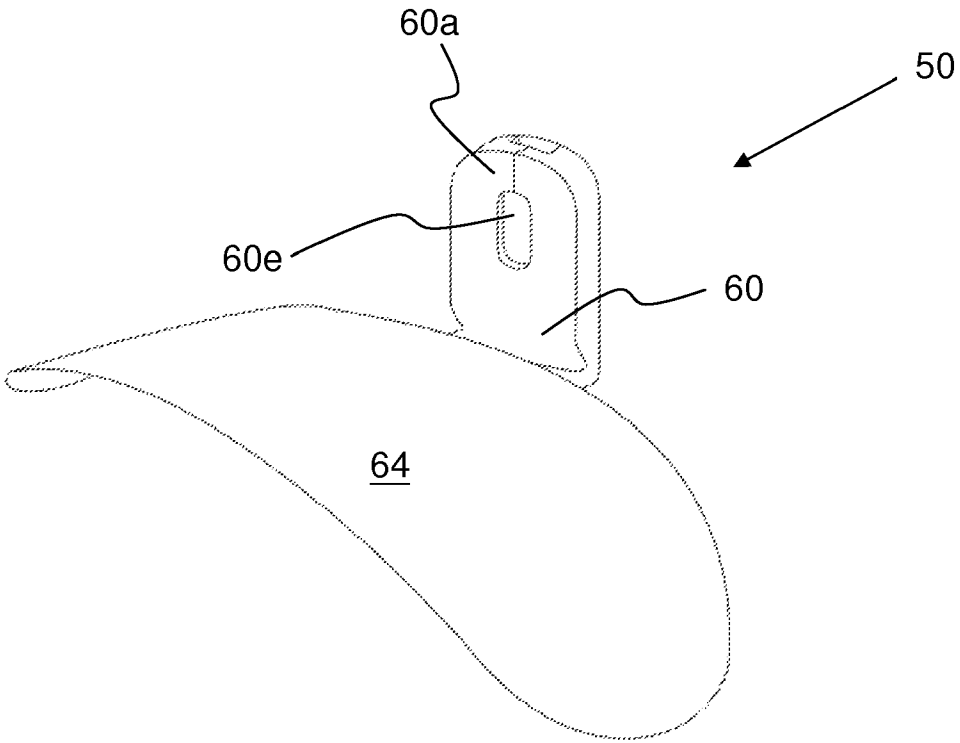
FIG. 1A, FIG. 1B, and FIG. 1C are perspective, side and top views of a shoulder rest for supporting a stringed instrument respectively according to one embodiment of the present invention.
Figure 1B:
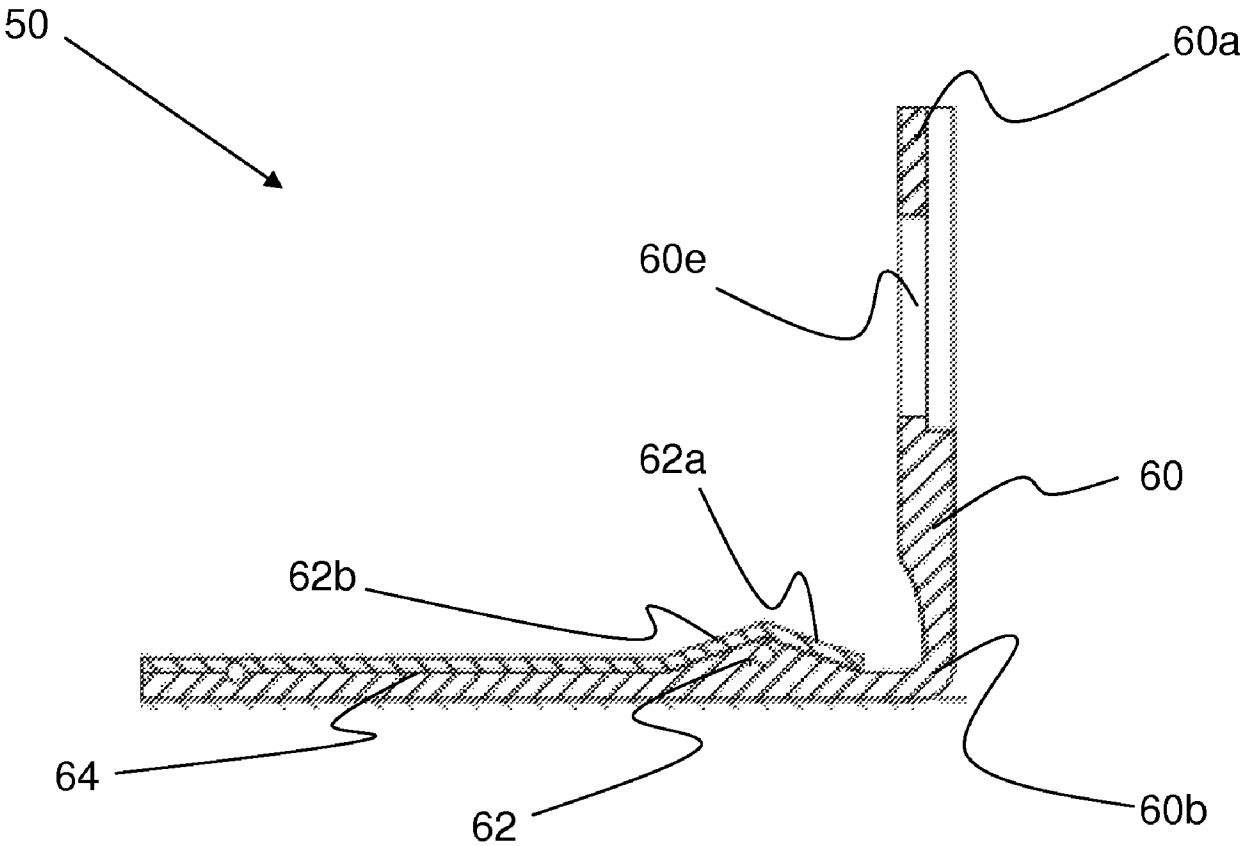
Figure 1C:
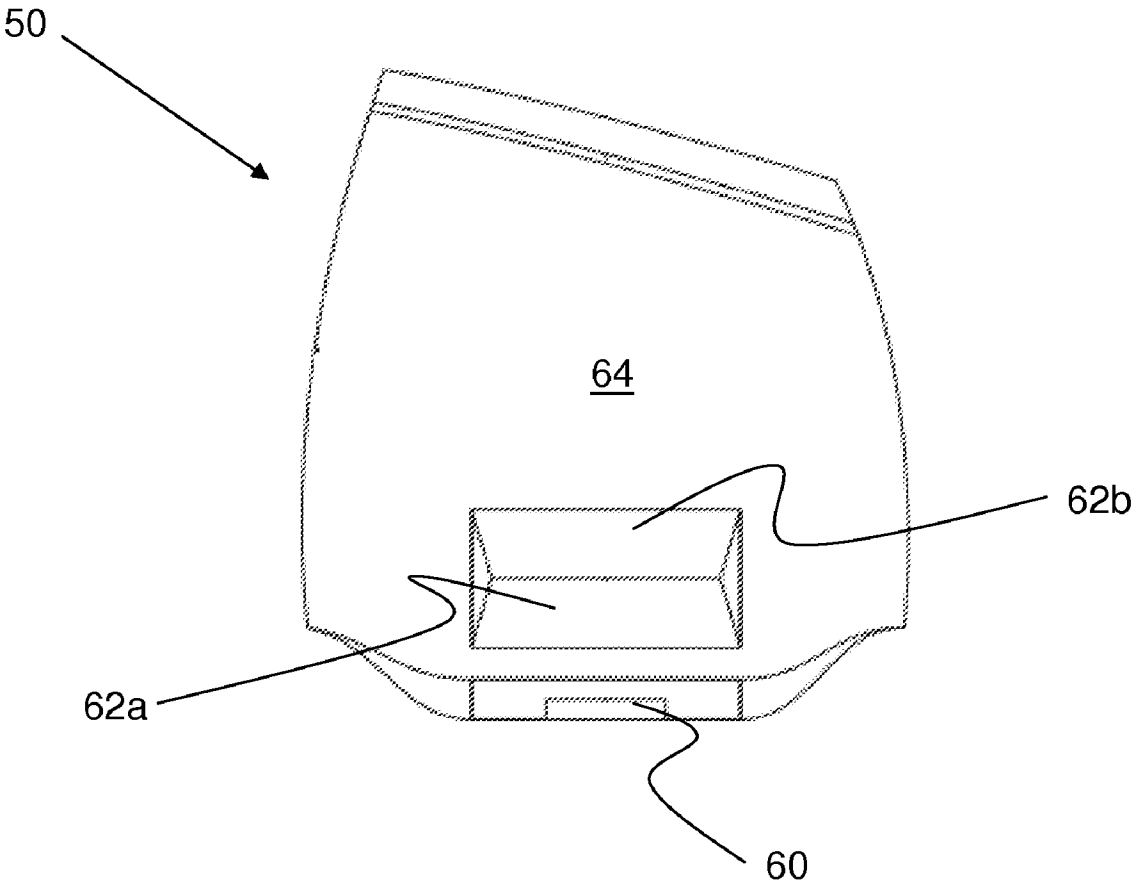

Referring first to FIGS. 1A, 1B and 1C, the first embodiment of the present invention is a shoulder rest 50 for supporting a stringed instrument which comprises an attachment piece 60, an abutment piece 62, and a padding piece 64. In the example shown, the attachment piece 60 is a flat plate containing a first end 60*a* and an opposing second end 60*b*. A slot 60*e* is provided within the first end 60*a*. The abutment piece 62 is a tongue extending from the second end 60*b* to form a substantially L-shaped support with the attachment piece 60. It has a shape of a ridge disposed across the upper surface of the tongue and horizontally aligned with the two ends of the attachment piece 60. The ridge of the abutment piece 62 contains a slanted inner surface 62*a* facing the attachment piece 60 and an adjacent slanted outer surface 62*b*. The padding piece 64 is a flexible pad attached to the abutment piece 62 that spreads around the plane thereof.

Figure 2A:
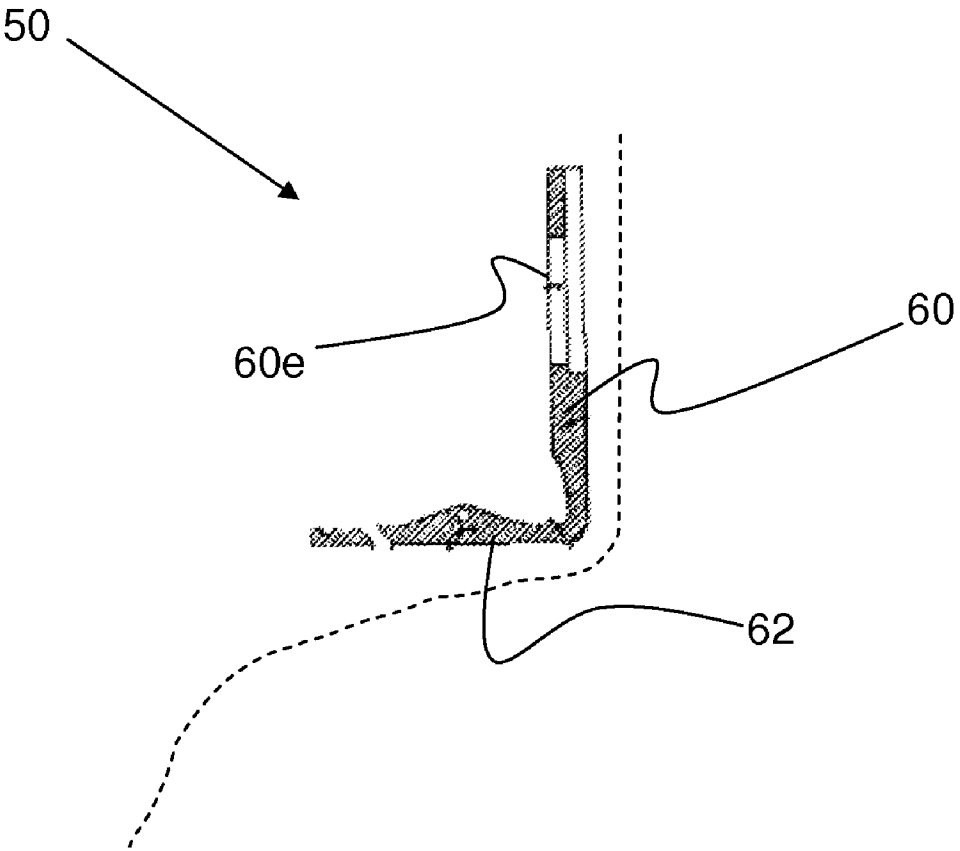
FIG. 2A is an illustration of the shoulder rest resting on a shoulder of a user without attaching to a stringed instrument according to the same embodiment of the present invention.
Figure 2B:
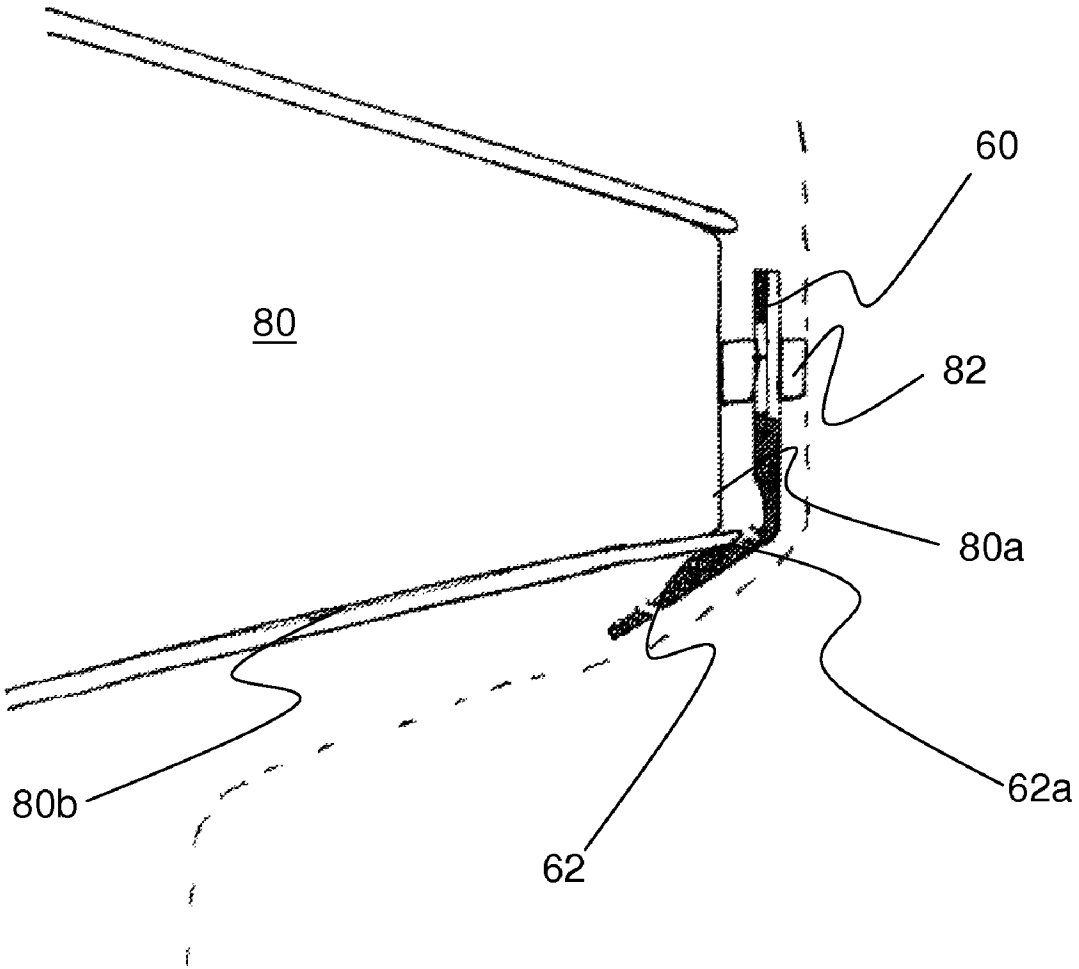
FIG. 2B is an illustration of the shoulder rest in use in which a stringed instrument is attached thereonto according to the same embodiment of the present invention.

Turning now to FIGS. 2A and 2B, the shoulder rest 50 can be attached onto a stringed instrument 80 by sliding the slot 60*e* through the neck of the end button 82. In the embodiment shown, the first end 60*a* consists of a slit next to the slot 60*e*. The slit can be pulled open to allow the end button 82 to be inserted into the slot 60*e* for attaching the shoulder rest 50 onto the stringed instrument 80. In the embodiment shown, the attachment piece 60 is made of rigid but yet elastic material and so it can aid in securing the attachment. As further illustrated in FIG. 2B, the tail-pin 80*a* of the stringed instrument 80 would come into contact to the inner surface 62*a* of the abutment piece 62 adapted to provide support to the stringed instrument 80 once rested onto the shoulder rest 50. As such, upon attachment of the attachment piece 60 onto the tail-pin 80*a*, the bottom board 80*b* of the stringed instrument 80 would be pressed onto the hard but flexible abutment piece 62, forcing open the L-shaped support joining the abutment piece 62 with the attachment piece 60. With the presence of the ridge, the distal side of the abutment piece 62 would be forced away from the bottom board 80*b* in order to minimize any contact that may occur between the bottom board 80*b* (that facilitates the generation of music through vibration) and the abutment piece 62. As such, damping of the stringed instrument 80 resting on the shoulder rest 50 could be minimized. Padding piece is not shown in both FIGS. 2A and 2B for ease of description.

Figure 3:
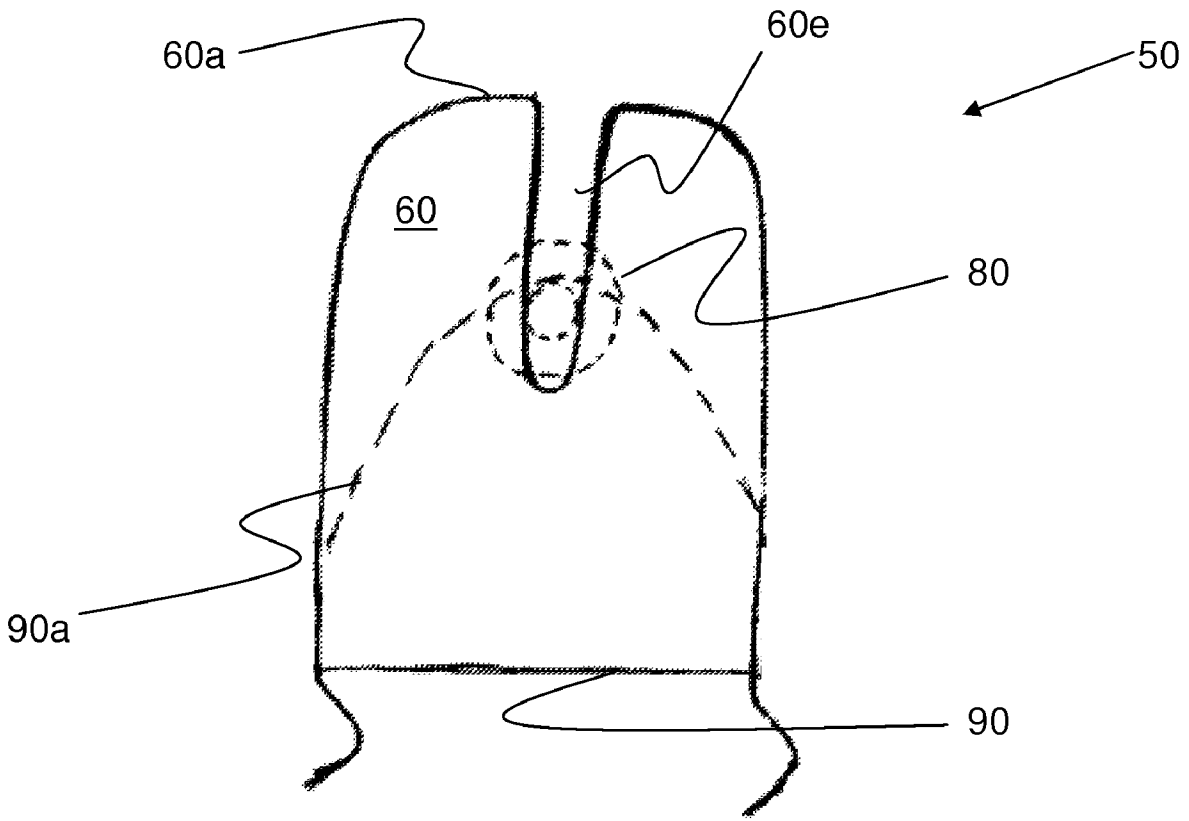
FIG. 3 is a perspective view of a shoulder rest for supporting a stringed instrument according to another embodiment of the present invention.

In another embodiment of the present invention, the attachment piece 60 of the shoulder rest 50 is provided with a size adjustment mechanism for the slot 60*e* to accommodate the clipping of the slot 60*e* onto end buttons with different sizes. The size adjustment mechanism in the embodiment illustrated in FIG. 3 is composed of a flexible band 90 which is attached to the attachment piece 60 at a back side thereof and stretches across the slot 60*e*. The size of the slot 60*e* can be adjusted by adjusting the length of the band 90 thereacross (as shown in dotted lines 90*a*, the extended form of band 90, in FIG. 3) and so end buttons with different sizes can be fitted with the shoulder rest.

On attaching the shoulder rest 50 onto the stringed instrument (not shown in FIG. 3), the end button 80 (shown in dotted lines in FIG. 3) is inserted into the slot 60*e*. In this specific embodiment, the slot 60*e* comprises an opening at the first end 60*a* of the attachment piece 60. Then, the flexible band 90 is stretched to wrap around the end button 80. As such, a resistive force is applied onto the end button 80 by the flexible band 90 to prevent it from being disconnected from the slot 60*e*.

With the use of the shoulder rest 50 of the present invention, the user can attain unrestricted movement of his/her clavicle during play while his/her stringed instrument 80 rests comfortably on his/her shoulder above on the shoulder rest 50. The padding piece 64 of the shoulder rest 50 is made and designed to conform to the contour of the user's shoulder and simultaneously contact the shoulder and the clavicle of the user during play. Since it is preferably made of a soft, flexible or formable material, both the sternoclavicular and acromial-clavicular joints of the user can be remained free and mobile. Further, the user's arm holding the stringed instrument 80 can now move in multiple orientations and directions.

The details of some embodiments of the present invention are thus fully described. Although the description refers to particular embodiments, it will be clear to one skilled in the art that the present invention may be practiced with variation of these specific details. Hence this invention should not be construed as limited to the embodiments set forth herein.

For example, the attachment piece and abutment piece are illustrated to be provided on the central position of the padding piece, but it is clear to one skilled in the art that these two pieces can be disposed on other positions of the padding piece according to the user's preference. The attachment piece and the abutment piece may be made of any rigid material, such as but not limited to plastic or wood, and can be of other shape and thickness according to the user's requirement based on the teaching provided herein. Further, the length and shape of the abutment piece can be varied according to one's preferences.

The attachment piece is illustrated in the aforesaid example to contain a slit followed by a slot to accommodate the end button. It is clear that other configurations of the attachment piece may be used based on the teaching provided herein. For example, a narrow slot may be provided instead of a slit, or other clamping mechanism may be used to secure the attachment piece to end button or the clamps around the end button or their equivalents according to the stringed instrument.

During use when the stringed instrument rests on the shoulder rest, the angle between the abutment piece and the attachment piece within the L-shaped support could be of any angle that fits the end of the stringed instrument resting thereon.

The padding piece of the shoulder rest can be made of a soft material such as soft rubber, sponge or quilt, among others. It can also be made of an ergonomically adjustable frame such that it can be modified to conform to different contours of different users according to one's preferences. For example, a wire frame or a formable material can also be used to support the soft material for the base such that the resulting shoulder rest can be adjusted to conform to the contour of the shoulder of the user.

Further, the padding piece can be designed to be detachable from the abutment piece such that when the shoulder rest is not in use, the user can disconnect the padding piece from the abutment piece, while the abutment piece remains attached to the stringed instrument, according to the his/her preferences.

A piece of soft material can also be incorporated onto the joint between the attachment piece and the abutment piece within the L-shaped support for extra protection to the stringed instrument resting onto the shoulder rest according to the preferences of the user.

The size adjustment mechanism as illustrated is composed of a flexible band in the embodiment described above, but it is clear to one skilled in the art that other forms such as Velcro, spring, screws or adaptors can be used to provide secure attachment of the shoulder rest onto the stringed instrument. The flexible band can be made of a resilient and flexible material such as soft rubber, nylon, a combination thereof, among others.

What is claimed is:

1. A shoulder rest for supporting a stringed instrument comprising a) an attachment piece adapted to secure said shoulder rest to a tail-pin of said stringed instrument;

b) an abutment piece, extending from said attachment piece, adapted to provide support to said stringed instrument once rested onto said shoulder rest; said attachment piece is coupled to said abutment piece in a L-shaped support configuration to provide an area for contact between said stringed instrument and said shoulder rest to support said stringed instrument; and c) a padding piece, connecting to said abutment piece, adapted to rest on and conform to the contour of a shoulder of a user, and simultaneously contact the shoulder and the clavicle of said user during usage;

wherein said attachment piece is adapted to clip onto an end button of said stringed instrument such that the contact surface between said stringed instrument and said shoulder rest is juxtaposing a bottom block of said stringed instrument.

2. The shoulder rest according to claim 1 wherein said abutment piece comprises a rigid material to minimize any contact between a bottom board of said stringed instrument and said shoulder rest upon attachment of said attachment piece onto said stringed instrument so as to prevent damping of said stringed instrument resting on said shoulder rest during usage.

3. The shoulder rest according to claim 2 wherein said abutment piece having the shape of a ridge further comprises a slanted inner surface facing said attachment piece and an adjacent slanted outer surface; upon attachment of said attachment piece onto said stringed instrument, the edge of said bottom block of said stringed instrument would press onto said inner surface to force open said L-shaped support for secure attachment of said shoulder rest to said stringed instrument while minimizing the contact between said bottom board and said shoulder rest.

4. The shoulder rest according to claim 1 wherein said padding piece comprises a wire frame that is shaped to conform to said contour of said shoulder of said user.

5. The shoulder rest according to claim 1 wherein said attachment piece further comprises a slot provided therewithin with a size adjustment mechanism; wherein during usage, end buttons in different sizes can be secured through said slot of said attachment piece.

6. The shoulder rest according to claim 5 wherein said size adjustment mechanism is composed of a flexible band provided across said slot to hold said end button of said stringed instrument within said slot after being inserted thereinto.

7. The shoulder rest according to claim 1 wherein said padding piece is adapted to be detachable from said abutment piece such that said abutment piece can remain attached to said stringed instrument while said padding piece can be disconnected from said stringed instrument when said shoulder rest is not in use.

8. A shoulder rest for supporting a stringed instrument comprising a) an attachment plate comprising a first end and an opposing second end, said first end having a slot adapted to mate with an end button of said stringed instrument for securing said shoulder rest to said stringed instrument;

b) an abutment piece rigidly extending from said second end of said attachment plate; and c) a flexible pad attaching to and spreading around said abutment piece along the plane thereof;

wherein the connection between said attachment plate and said abutment piece forms a L-shaped support therebetween to provide an area for contact between said stringed instrument and said shoulder rest to support said stringed instrument; and said abutment piece enables the contact surface between said stringed instrument and said shoulder rest to rest at a bottom block of said stringed instrument; the angle formed between said attachment plate and said abutment piece allows said abutment piece to support the edge of said bottom board juxtaposing said bottom block during usage while minimizing the contact of said bottom board of said stringed instrument with said shoulder rest; and said pad is adapted to simultaneously contact and protect the shoulder and the clavicle of said user during usage.

9. The shoulder rest according to claim 8 wherein said abutment piece having the shape of a ridge disposed across the upper surface of said abutment piece and horizontally aligned with said first and second ends of said attachment plate; said abutment piece further comprises a slanted inner surface facing said attachment piece and an adjacent slanted outer surface; upon attachment of said attachment piece onto said stringed instrument, the edge of said bottom block of said stringed instrument would press onto said inner surface to force open said L-shaped support for secure attachment of said shoulder rest to said stringed instrument while minimizing the contact between said bottom board and said shoulder rest.

10. The shoulder rest according to claim 8 wherein said pad comprises a wire frame that is shaped to conform to said contour of said shoulder of said user.

11. The shoulder rest according to claim 8 wherein said attachment plate is further provided with a size adjustment mechanism for said slot such that during usage, end buttons in different sizes can be secured through said slot of said attachment plate.

12. The shoulder rest according to claim 11 wherein said size adjustment mechanism is composed of a flexible band provided across said slot to hold said end button of said stringed instrument within said slot after being inserted thereinto.

13. The shoulder rest according to claim 8 wherein said pad is adapted to be detachable from said abutment piece such that said abutment piece can remain attached to said stringed instrument while said pad can be disconnected from said stringed instrument when said shoulder rest is not in use.

* * * * *